US011185199B2

(12) United States Patent
Choi et al.

(10) Patent No.: US 11,185,199 B2
(45) Date of Patent: Nov. 30, 2021

(54) VACUUM CLEANER

(71) Applicant: Samsung Electronics Co., Ltd., Suwon-si (KR)

(72) Inventors: Jiwon Choi, Suwon-si (KR); Dongjun Kim, Suwon-si (KR); Byoungin Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 296 days.

(21) Appl. No.: 16/534,917

(22) Filed: Aug. 7, 2019

(65) Prior Publication Data

US 2020/0046183 A1 Feb. 13, 2020

(30) Foreign Application Priority Data

Aug. 9, 2018 (KR) ..... 10-2018-0092954

(51) Int. Cl.

| | |
|---|---|
| ***A47L 7/00*** | (2006.01) |
| ***A47L 9/04*** | (2006.01) |
| *A47L 9/16* | (2006.01) |

(52) U.S. Cl.

CPC ..... *A47L 7/0066* (2013.01); *A47L 9/0477* (2013.01); *A47L 9/0488* (2013.01); *A47L 9/1683* (2013.01); *A47L 2201/00* (2013.01)

(58) Field of Classification Search

CPC .... A47L 7/0066; A47L 9/0477; A47L 9/0488; A47L 9/1683; A47L 2201/00

See application file for complete search history.

(56) References Cited

U.S. PATENT DOCUMENTS

| | | | | |
|---|---|---|---|---|
| 2017/0280957 | A1 | 10/2017 | Jeong et al. | |
| 2019/0000289 | A1* | 1/2019 | Li | B08B 1/00 |
| 2019/0208971 | A1* | 7/2019 | O'Brien | A47L 11/4041 |
| 2021/0068601 | A1* | 3/2021 | Carter | A47L 9/0461 |

FOREIGN PATENT DOCUMENTS

| | | | |
|---|---|---|---|
| EP | 3342323 | A2 | 7/2018 |
| JP | 2009268684 | A | 11/2009 |
| KR | 10-2017-0111688 | A | 10/2017 |

OTHER PUBLICATIONS

European Search Report dated Feb. 3, 2020 in connection with European Patent Application No. 19 19 0616, 5 pages.

* cited by examiner

*Primary Examiner* — David Redding

(57) ABSTRACT

A vacuum cleaner includes a foreign-substance suction unit having a drum brush to suck foreign substances by the suction power rotating on a floor to be cleaned. The drum brush includes a rotary body having a cylindrical drum and foreign-substance collecting grooves formed at opposite end portions of the drum along a circumferential direction; a cleaning member disposed on a circumferential surface of the drum; at least one nozzle spirally extended across the cleaning member along a lengthwise direction of the drum to guide foreign substances toward the foreign-substance collecting groove; and a foreign-substance winding portion disposed in a portion of the foreign-substance collecting groove to wind the guided foreign substances. The drum brush may effectively guide, wind, and cut a hair and the like foreign substances on a carpet and the like bottom, thereby effectively preventing the hair and the like foreign substances from being piled up.

20 Claims, 13 Drawing Sheets

VACUUM CLEANER

CROSS-REFERENCE TO RELATED THE APPLICATION

This application is based on and claims priority under 35 U.S.C. § 119 to Korean Patent Application No. 10-2018-0092954 filed on Aug. 9, 2018 in the Korean Intellectual Property Office, the disclosure of which is incorporated by reference herein in its entirety.

BACKGROUND

1. Field

The disclosure relates to a foreign-substance suction unit, and more particularly to a vacuum cleaner including a drum brush improved in performance of sucking up foreign substances.

2. Description of the Related Art

A vacuum cleaner includes a foreign-substance suction unit with a drum brush to clean a floor such as a carpet deeply covered with foreign substances. The drum brush hits a target object while rotating, thereby separating the foreign substances from the carpet or cracks in the floor. The vacuum cleaner sucks up such separated foreign substances through the foreign-substance suction unit. Like this, the drum brush is useful when a suction inlet of the vacuum cleaner is placed near a carpet surface and sucks up the foreign substances from the depths of naps on a carpet.

The drum brush includes a cleaning member having a cleaning brush on a circumferential surface thereof, for example, a drum around which cotton flannel is wound. However, such a soft and fine cleaning brush provided on the drum has a structure vulnerable to a tangle of hairs or the like. In particular, the hardness of the cotton flannel used as the cleaning brush is so low that a hair or the like elongated foreign substances can be accumulated when the cleaning brush is used for a long time. Therefore, the drum brush has problems of restricted rotation or shortened life due to the accumulated foreign substances.

SUMMARY

An aspect of the disclosure is to provide a vacuum cleaner having a drum brush which effectively guides, strongly winds, cuts and sucks a hair and the like foreign substances.

Another aspect of the disclosure is to provide a vacuum cleaner having a drum brush to which a nozzle for guiding foreign substances is firmly mounted.

Still another aspect of the disclosure is to provide a vacuum container having a drum brush by which an efficiency of cleaning foreign substances is improved.

According to an embodiment, there is provided a vacuum cleaner. The vacuum cleaner includes a foreign-substance suction unit comprising a cleaner main body configured to generate suction power, and a drum brush configured to suck foreign substances by the suction power rotating on a floor to be cleaned. The drum brush includes a rotary body comprising a cylindrical drum and foreign-substance collecting grooves formed at opposite end portions of the drum along a circumferential direction; a cleaning member disposed on a circumferential surface of the drum; at least one nozzle spirally extended across the cleaning member along a lengthwise direction of the drum and configured to guide foreign substances toward the foreign-substance collecting groove; and a foreign-substance winding portion disposed in a portion of the foreign-substance collecting groove and configured to wind the guided foreign substances. The vacuum cleaner of the disclosure employs the foreign-substance winding portion disposed in a portion of the foreign-substance collecting groove, thereby strongly and easily winding a hair.

The foreign-substance winding portion may be formed at one end portion of the nozzle as a single body, thereby facilitating manufacture and mounting and preventing the nozzle from being taken off.

The foreign-substance suction unit may include a grinder provided at a predetermined distance from the foreign-substance winding portion and configured to cut foreign substances wound around the foreign-substance winding portion, thereby effectively cutting and sucking the wound foreign substances.

The nozzle or the foreign-substance winding portion may include synthetic rubber, synthetic resin or natural rubber, thereby easily guiding and winding the foreign substance with strong friction.

The nozzle may include two or more blades arranged side by side along a lengthwise direction leaving a space therebetween, thereby easily exposing foreign substances on the floor, and easily guiding the foreign substances toward the foreign-substance collecting groove at an end portion of the drum while preventing the foreign substances from being wedged between the cleaning member and the nozzle.

The drum may include a nozzle-mounting portion comprising a holding groove spirally and penetratingly extended along a lengthwise direction, and a holding projection opened with a width narrower than the holding groove in the circumferential direction of the drum and communicating with an outside, and the nozzle may include a holder extended to be inserted in the holding groove, and a connector narrower than the holder, inserted in the holding projection, and configured to connect the blade and the holder as a single body, thereby firmly supporting the nozzle.

The one of the two or more blades may be higher than the other blades, thereby improving an efficiency of cleaning the foreign substances and enhancing the durability of the blades.

The nozzle may include three blades arranged side by side along a lengthwise direction leaving a space therebetween, and a central blade among three blades is higher than the other blades, thereby improving an efficiency of cleaning the foreign substances and enhancing the durability of the blades.

The nozzle may include a bottom portion connecting bottoms of the two or more blades and a bottom extending portion extended from the bottom portion over an outermost blade, thereby firmly supporting the cleaning member.

The nozzle may include a bottom portion connecting bottoms of two or more blades and at least one middle coupling portion extended upward from the bottom portion and configured to couple the two or more blades, thereby preventing the durability of the blade from being lowered.

The bottom portion may be extended having an arch shape along the circumferential direction of the drum, thereby firmly supporting the cleaning member.

The cleaning member may include a base and a cleaning brush provided on the base, and the blade may be formed to have an upper end lower than the cleaning brush, thereby reducing hit noise caused when the drum rotates for cleaning.

The foreign-substance collecting groove may be formed to have a fanwise shape along the circumferential direction of the drum, thereby effectively winding the guided foreign substances.

The foreign-substance collecting groove may include a pair of flanges spaced apart from each other, and a recessed groove formed between the pair of flanges along the circumferential direction, thereby securing a space in which the guided foreign substances are wound.

The foreign-substance collecting groove may include a mounting groove to which the foreign-substance winding portion is mounted, thereby firmly supporting the foreign-substance winding portion.

The foreign-substance winding portion may be mounted to the mounting groove and protrudes from a surface of the recessed groove of the foreign-substance collecting groove, thereby making the guided foreign substance be wound around the foreign-substance winding portion.

The foreign-substance winding portion may include first and second standing walls standing being spaced apart from each other, an inclined wall inclined downward from the first standing wall, and a connection wall connecting the inclined wall and the second standing wall, thereby securing a space in which the guided foreign substances are wound.

The mounting groove may include a through hole passing through the flange adjacent to the drum between the pair of flanges, and a fastening groove recessed in the other flange in a central axis direction of the drum, and the first and second standing walls may be respectively inserted in the through hole and the fastening groove, thereby firmly keeping the mounted foreign-substance winding portion during operation.

The rotary body may include at least one middle foreign-substance collecting groove between opposite end portions thereof, and the drum may include at least two drums separated by the at least one middle foreign-substance collecting groove, thereby reducing a guide path of the foreign substance.

The drum brush may include a middle foreign-substance winding portion mounted to the middle foreign-substance collecting groove by insert-injection, thereby reducing a guide path of the foreign substance.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

The above and/or the aspects will become apparent and more readily appreciated from the following description of various embodiments, taken in conjunction with the accompanying drawings, in which.

and

Figure 13:
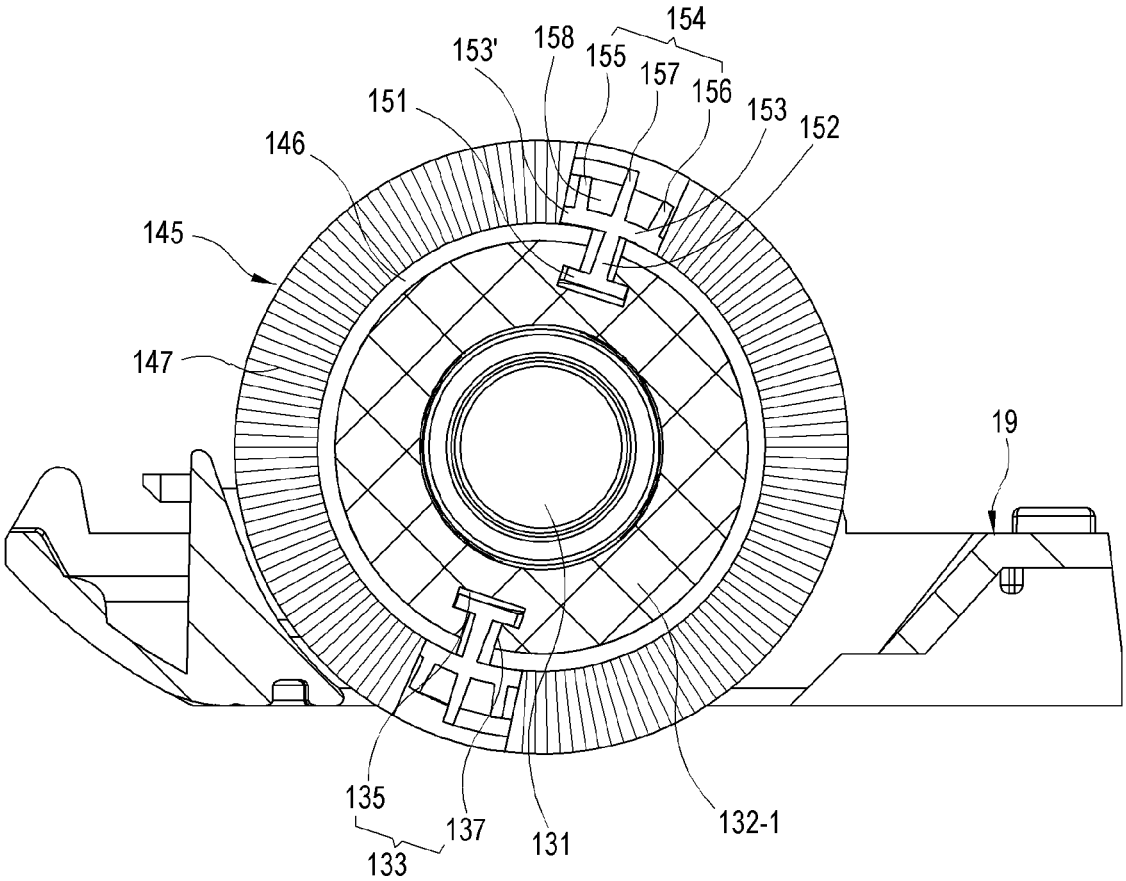

FIG. 13 illustrates a cross-section of a nozzle according to another embodiment of the disclosure.

DETAILED DESCRIPTION

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Below, embodiments of a vacuum cleaner 1 according to the disclosure will be described in detail with reference to accompanying drawings. To help understanding of the following embodiments, it will be described by way of example that a vacuum cleaner 1 is applied to a robot vacuum cleaner. However, it will be appreciated that a canister-type vacuum cleaner, an upright-type vacuum cleaner, a stick-type vacuum cleaner, and the like according to various alternative embodiments are also applied on the contrary to the embodiment set forth herein. In terms of describing the disclosure, the detailed description and concrete illustration for the related well-known functions or elements will be omitted when they cloud the gist of the disclosure.

Figure 1:
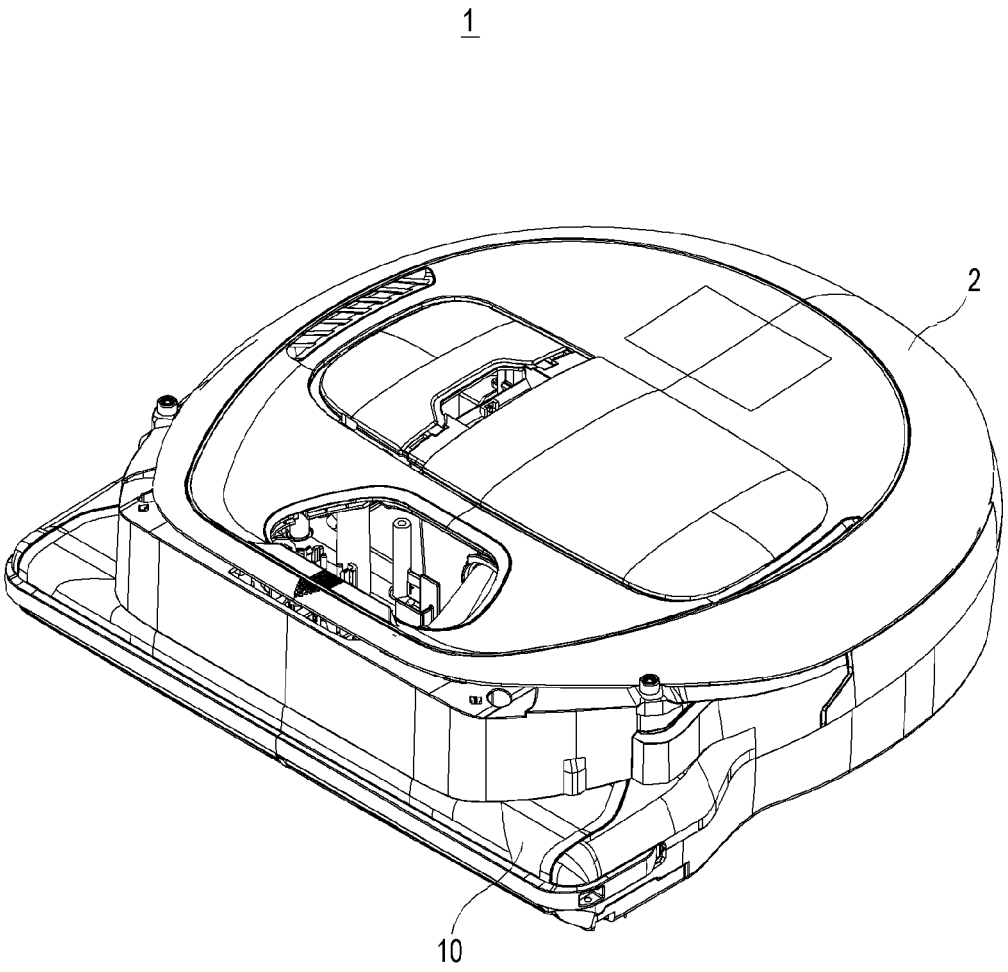
FIGS. 1 and 2 illustrate top and bottom perspective views of a vacuum cleaner according to an embodiment of the disclosure.
Figure 2:
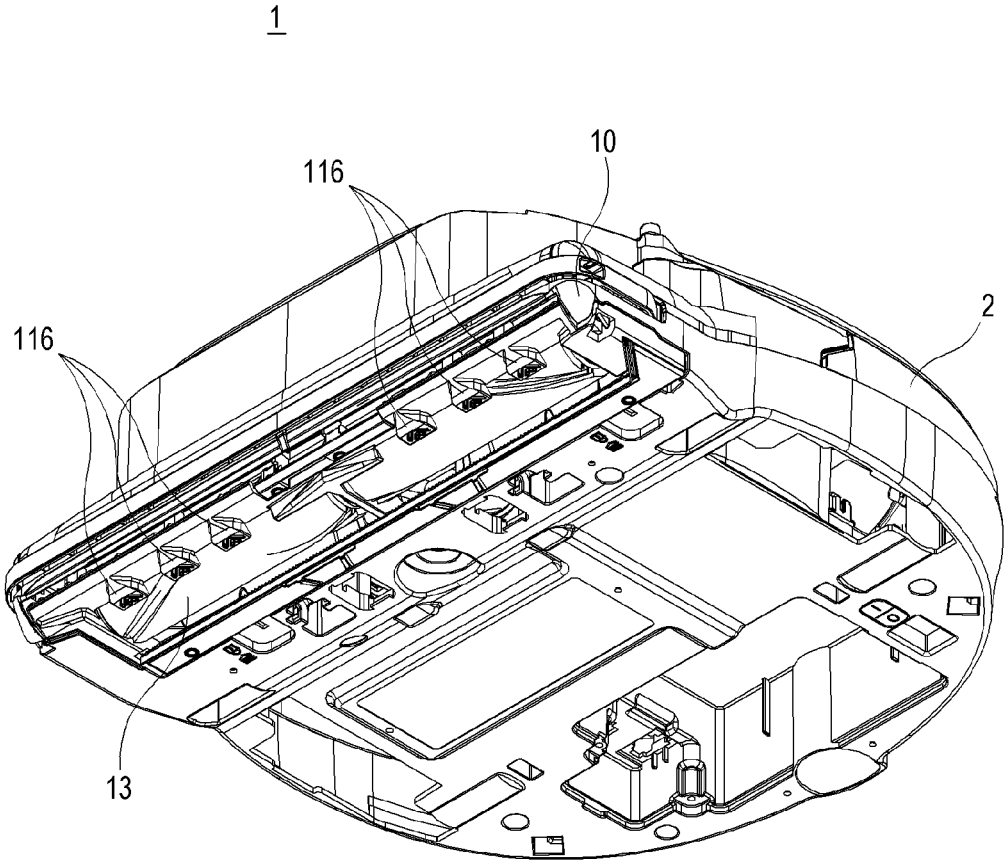
Figure 3:
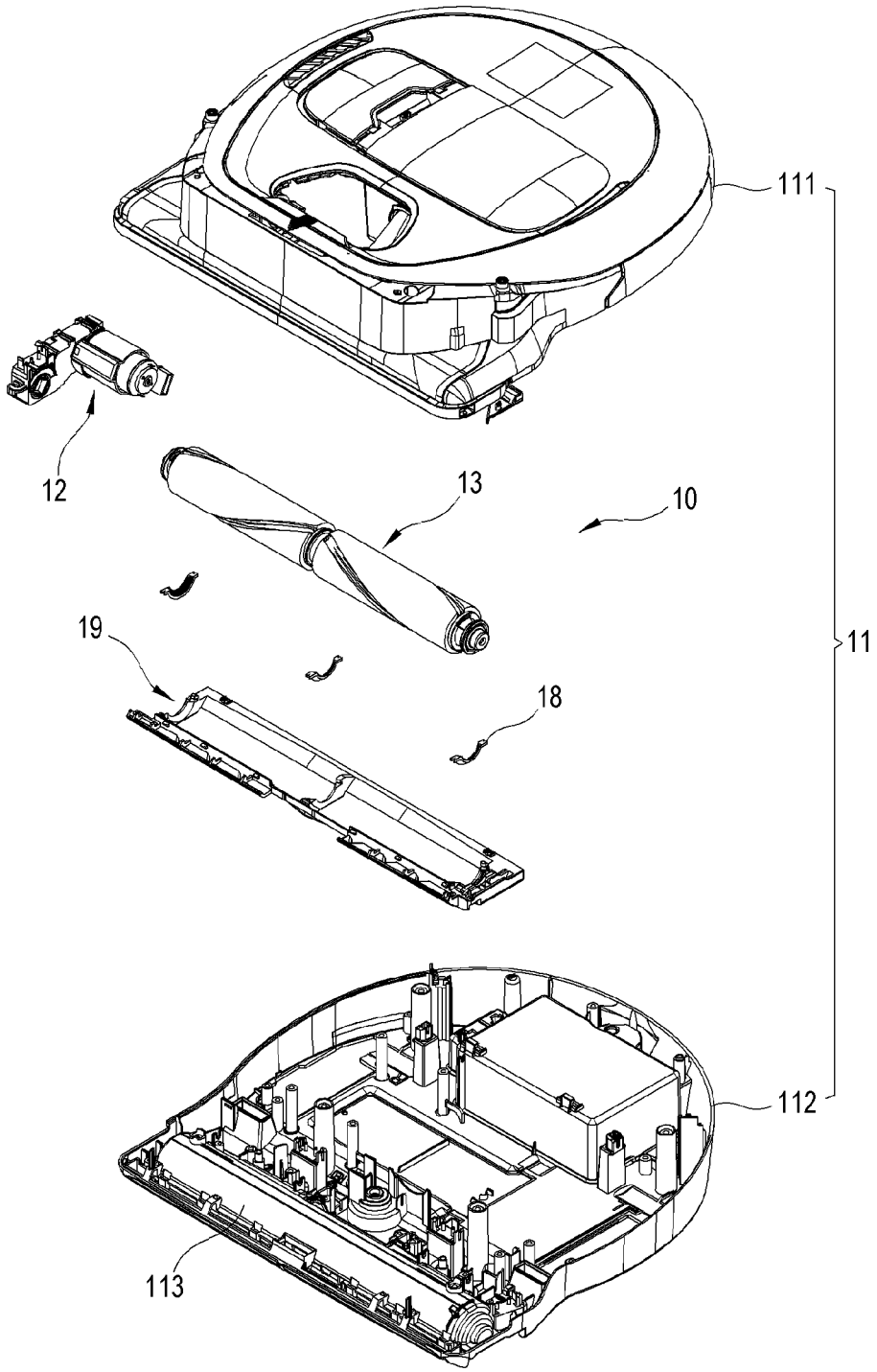
FIGS. 3 and 4 illustrate an exploded perspective view and a lateral cross-section view of a foreign-substance suction unit according to an embodiment of the disclosure.
Figure 4:
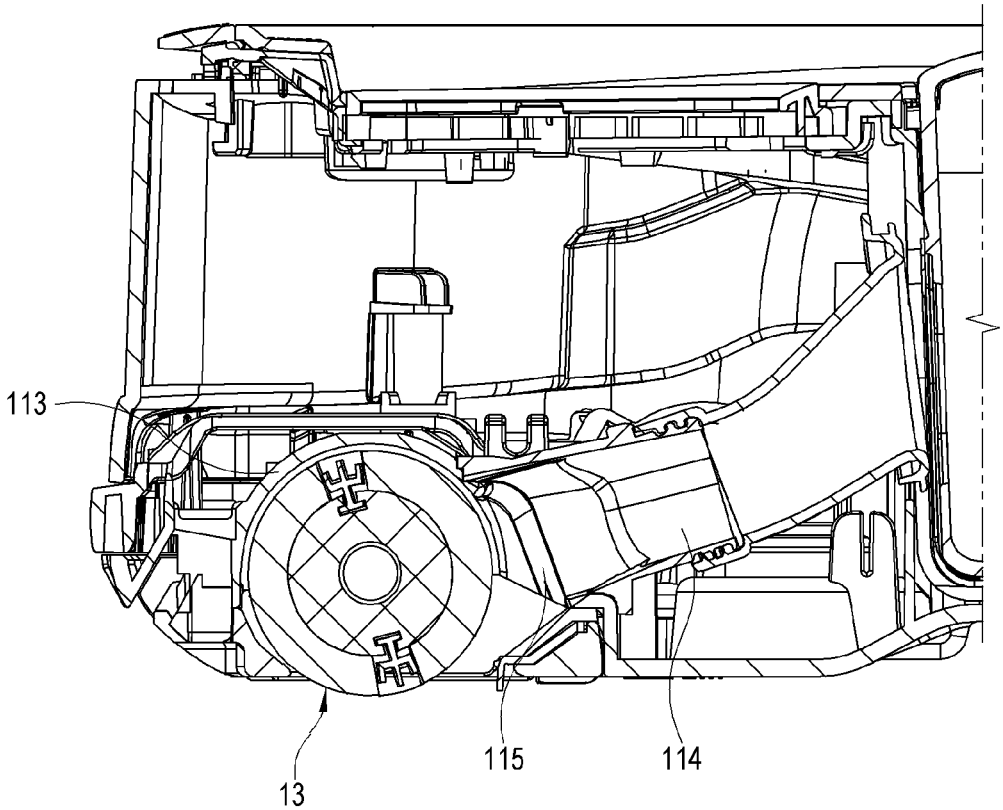

FIGS. 1 and 2 illustrate perspective views of a vacuum cleaner according to an embodiment of the disclosure. FIGS. 3 and 4 illustrate an exploded perspective view and a lateral cross-section view of a foreign-substance suction unit according to an embodiment of the disclosure. According to an embodiment of the disclosure, the vacuum cleaner 1 includes a cleaner main body 2 to generate suction power, and a foreign-substance suction unit 10.

The cleaner main body 2 includes a suction motor (not shown) to generate suction power, and a dust collector (not shown).

The suction motor generates predetermined suction power to suck up trash from a floor to be cleaned.

The dust collector may collect the trash sucked into the cleaner main body 2 through the foreign-substance suction unit 10 by the suction power. The dust collector may include a filter configured to collect foreign substances sucked up by the suction power. The dust collector may have a cyclonic structure to separate the trash from air inhaled by centrifugal force.

Referring to FIG. 3, a vacuum cleaner 1 includes a case 11, a drum brush 13 provided in the case 11 and rotated by a driver 12, a grinder 18, and a base member 19.

The case 11 may include an upper case 111 and a lower case 112 coupled to each other. Alternatively, the upper case 111 and the lower case 112 may be manufactured as a single body.

The lower case 112 includes an approximately semi-cylindric drum accommodator 113 formed on a portion facing toward the floor and rotatably accommodating the drum brush 13.

Referring to FIG. 4, the drum accommodator 113 includes a suction inlet 115 which communicates with a suction channel 114 in inward and backward directions. The foreign substances on the floor to be cleaned are collected in the drum accommodator 113 by the drum brush 13 and then sucked through the suction inlet 115 and the suction channel 114.

Referring back to FIG. 2, the lower case 112 includes a plurality of foreign-substance suction groove 116 formed along a front bottom and sucking up foreign substances into the drum accommodator 113. When the lower case 112 is put on a wooden floor or the like floor to be cleaned, an idle wheel (not shown) forms a predetermined gap between the bottom of the lower case 112 and the floor to be cleaned. Therefore, the foreign substance on the floor to be cleaned may be sucked into the drum accommodator 113 through not only the plurality of foreign-substance suction grooves 116 but also the gap between the bottom of the lower case 112 and the floor to be cleaned.

Meanwhile, when the suction motor of the vacuum cleaner 1 generates negative pressure in the suction channel, the negative pressure is also generated in the drum accommodator 113. Therefore, the foreign substance (e.g. a foreign material, trash, a hair, etc.) on the floor to be cleaned is sucked by air flow based on difference in pressure from the surrounding outside of the drum accommodator 113. Typically, when a carpet (not shown) and the like material is covered with foreign substances, only inhalation of air is insufficient to suck up the foreign substances from the depths of the carpet. Thus, the drum brush 13 brushes away the foreign substances deeply attached to many naps on the carpet, and makes the foreign substances fly upward from the carpet, and such flying foreign substances are sucked into the suction inlet 115 of the drum accommodator 113.

The foreign-substance suction unit 10 includes the driver 12, the drum brush 13, the grinder 18 and the base member 19.

Figure 5:
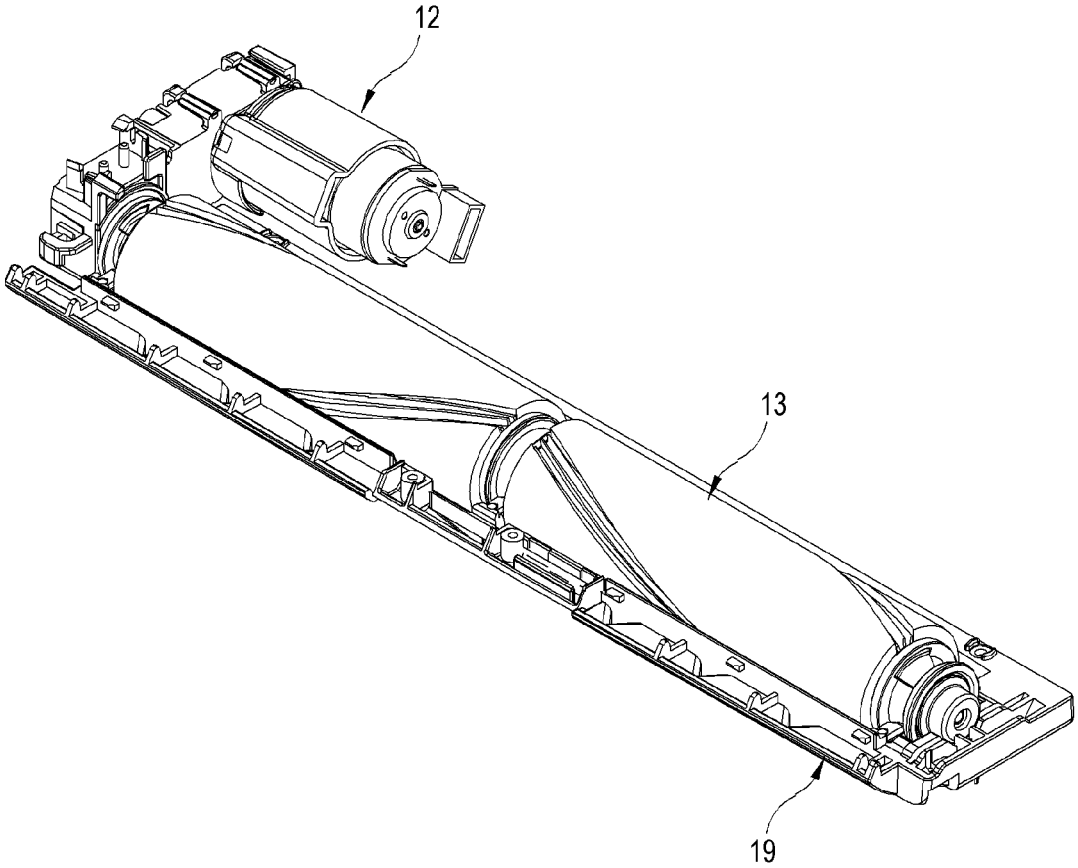
FIG. 5 illustrates a perspective view of a drum brush according to an embodiment of the disclosure.
Figure 6:
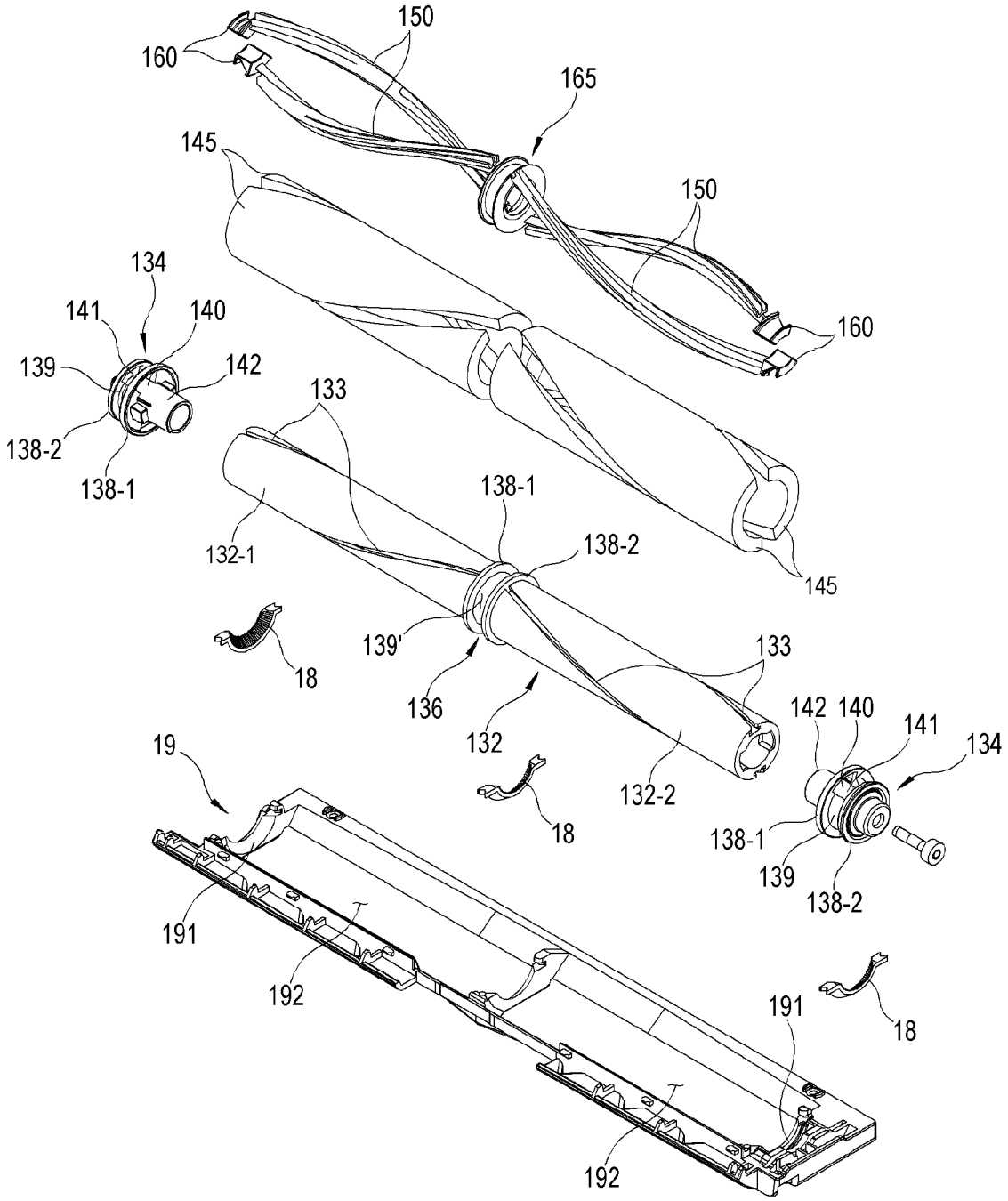
FIG. 6 illustrates an exploded perspective view of a drum brush according to an embodiment of the disclosure.
Figure 7:
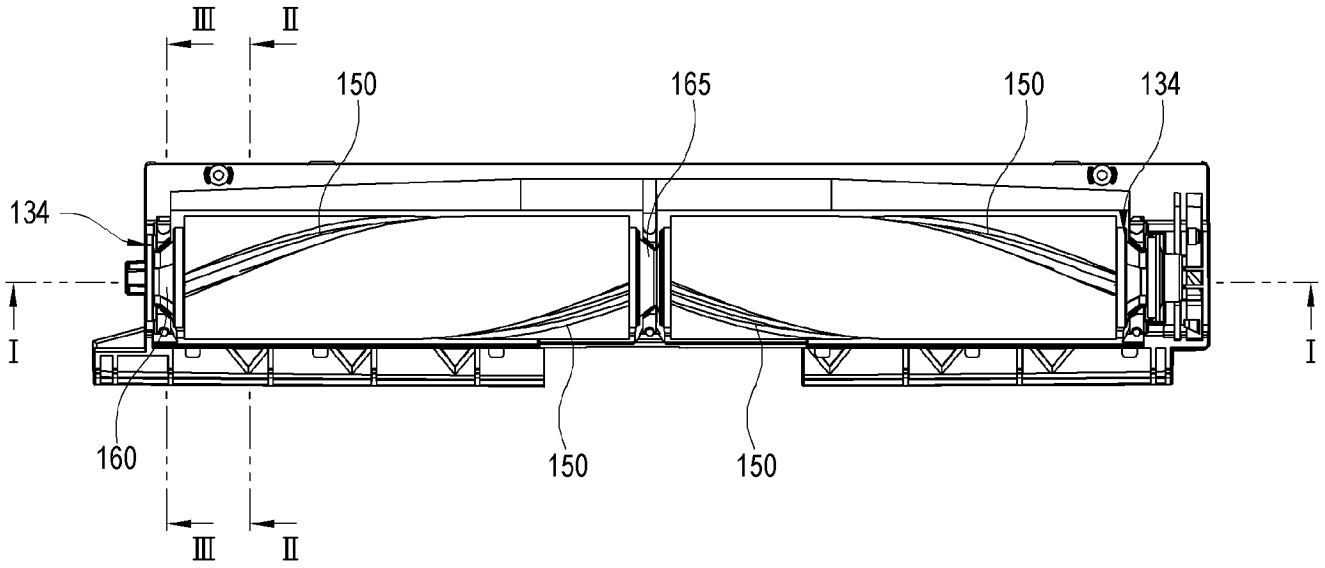
FIG. 7 illustrates a lateral view of a drum brush according to an embodiment of the disclosure.
Figure 8:
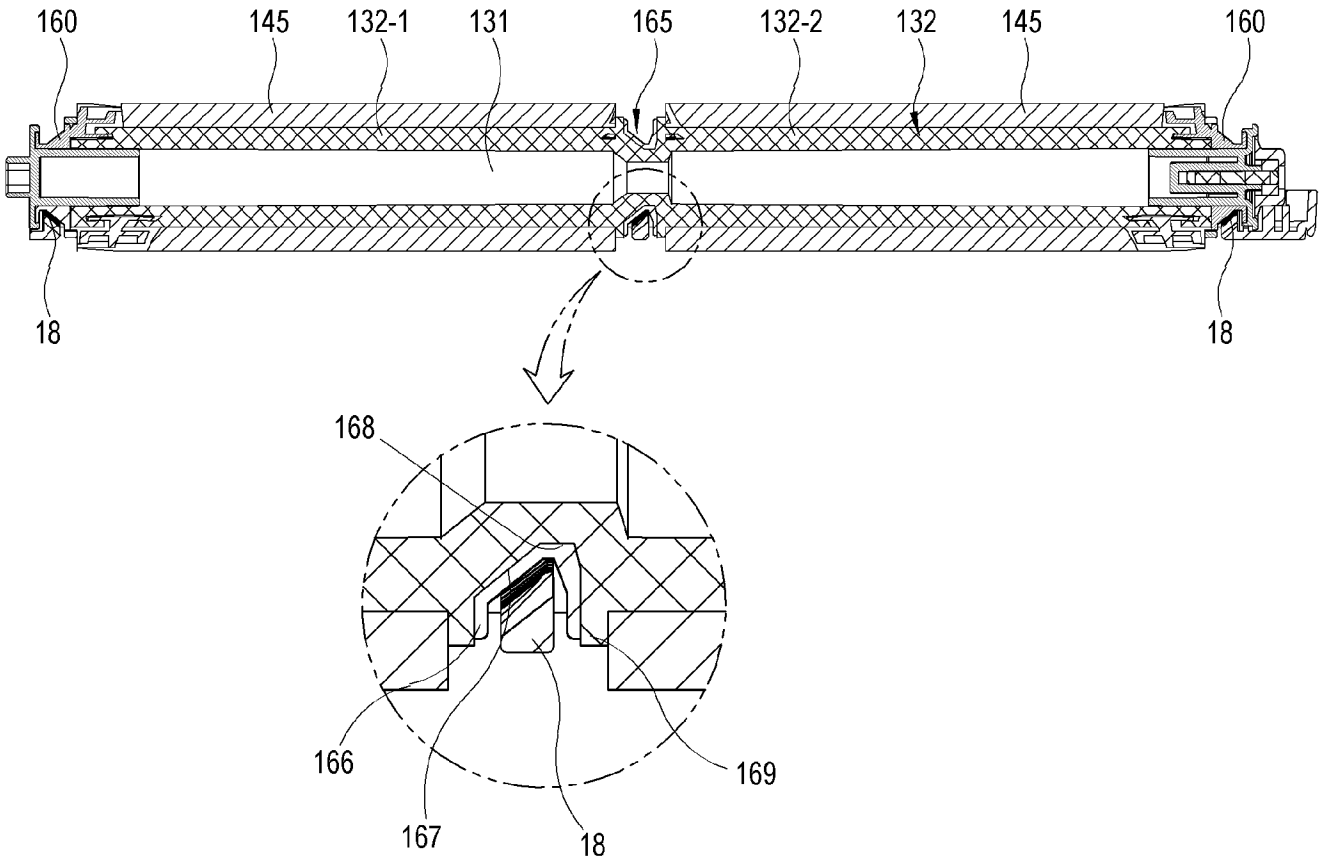
FIG. 8 illustrates a cross-section view taken along line I-I of FIG. 7.
Figure 9:
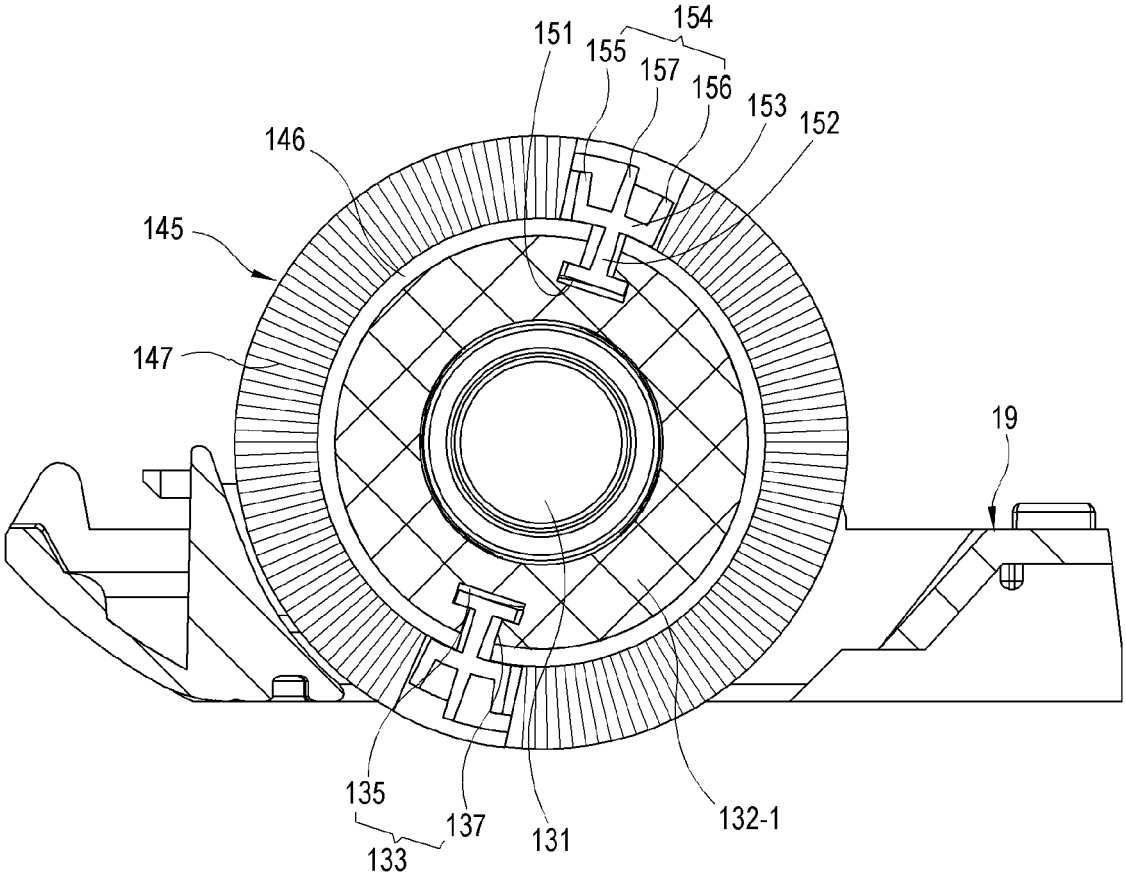
FIG. 9 illustrates a cross-section view taken along line II-II of FIG. 7.
Figure 10:
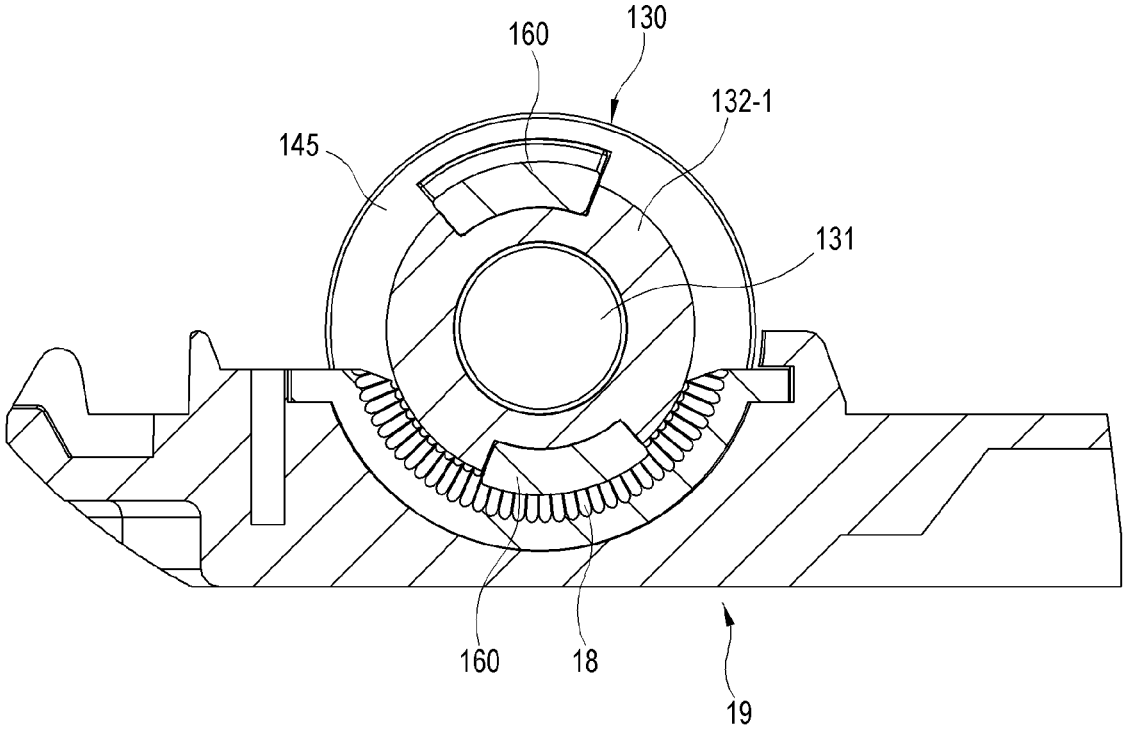
FIG. 10 illustrates a cross-section view taken along line of FIG. 7.
Figure 11:
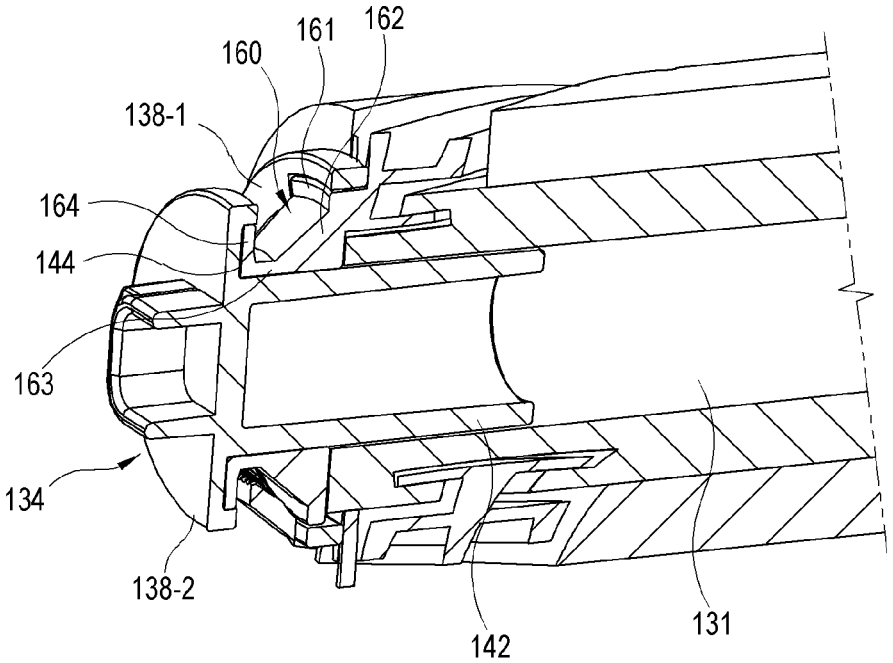
FIG. 11 illustrates a partial enlarged view of a cross-section taken along line IV-IV of FIG. 5.
Figure 12:
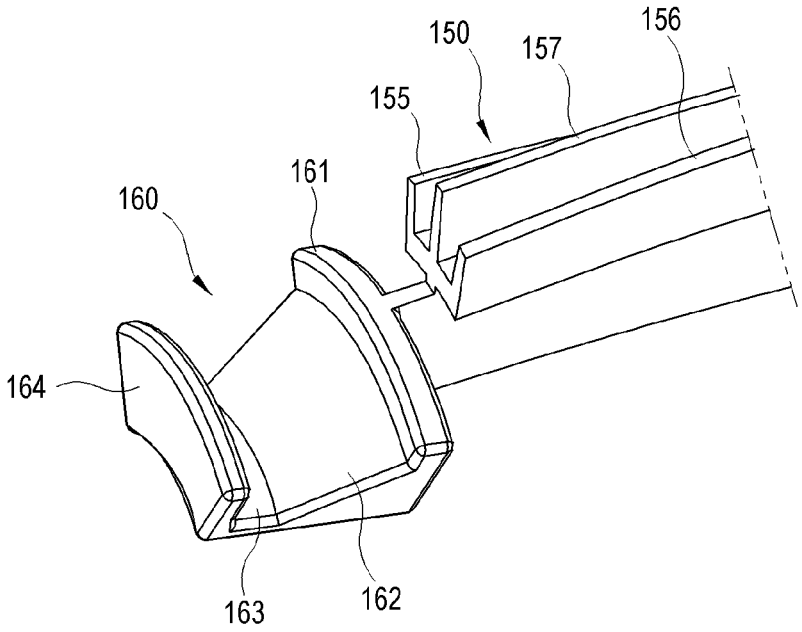
FIG. 12 illustrates a perspective view of a foreign-substance winding portion.

FIG. 5 illustrates a perspective view of a drum brush according to an embodiment of the disclosure, FIG. 6 illustrates an exploded perspective view of a drum brush according to an embodiment of the disclosure, FIG. 7 illustrates a lateral view of a drum brush according to an embodiment of the disclosure, FIG. 8 illustrates a cross-section view taken along line I-I of FIG. 7, FIG. 9 illustrates a cross-section view taken along line II-II of FIG. 7, and FIG. 10 illustrates a cross-section view taken along line of FIG. 7. FIG. 11 illustrates a partial enlarged view of a cross-section taken along line IV-IV of FIG. 5. FIG. 12 illustrates a perspective view of a foreign-substance winding portion. FIG. 13 illustrates a cross-section of a nozzle according to another embodiment of the disclosure.

Referring to FIGS. 5 and 6, the driver 12 may be placed inside the case 11 as a power source for driving a rotary body 130 of the drum brush 13. The driver 12 may be actualized by a motor, and transfer rotary power to the drum brush 13, thereby providing power for rotating the drum brush 13.

The drum brush 13 includes the rotary body 130, a cleaning member 145 provided on the circumferential surface of the rotary body 130, a nozzle 150 spirally provided along the lengthwise direction of the rotary body 130 and guiding the foreign substances, a foreign-substance winding portion 160 connected to a one end portion of the nozzle 150 as a single body and winding the guided foreign substances, and a middle foreign-substance winding portion 165 provided in the middle of the rotary body 130.

The rotary body 130 includes a cylindrical drum assembly 132 rotating with respect to a rotary shaft (see '131' in FIG. 8) in the lengthwise direction, one pair of foreign-substance collecting grooves 134 provided at opposite end portions of the drum assembly 132, and a middle foreign-substance collecting groove 136 provided in the middle of the drum assembly 132.

The drum assembly 132 includes one pair of drums 132-1 and 132-2 arranged side by side in line along the lengthwise direction. One pair of drums 132-1 and 132-2 respectively support one pair of cleaning members 145 and one pair of nozzles 150. Each of the drum 132-1 and 132-2 includes one pair of nozzle-mounting portions 133 spirally extended long along the lengthwise direction. The drum assembly 132 may include a single drum or three or more drums. The drum assembly 132 may be manufactured by plastic injection-molding.

Referring to FIGS. 6 and 9, one pair of nozzle-mounting portions 133 are provided on the circumferential surfaces of the drums 132-1 and 132-2 and face with each other across a rotary axis. The nozzle-mounting portion 133 includes a holding groove 135 spirally penetrating the drums 132-1 and 132-2 in the lengthwise direction, and a holding projection 137 narrower than the holding groove 135, opened in the circumferential direction of the drums 132-1 and 132-2, and communicating with the outside. The nozzle 150 is fitted and mounted from both ends of the drum assembly 132 to the middle through the holding groove 135 and the holding projection 137. The nozzle-mounting portion 133 is not limited to the foregoing structure, but may be spirally and firmly mounted to the circumferential surface of the drums 132-1 and 132-2 by various methods such as an adhesive (gluing) method, a hooking method, a forcible-fitting method, etc. A single nozzle-mounting portion 133 or three or more nozzle-mounting portions 133 may be provided with respect to each of the drums 132-1 and 132-2.

Referring to FIGS. 6 and 11, one pair of foreign-substance collecting grooves 134 are each shaped like a spool and coupled to or integrated into both ends of the drum assembly 132. The foreign-substance collecting groove 134 includes one pair of circular flanges 138-1 and 138-2 spaced apart from each other, a recessed groove 139 provided between the pair of flanges 138-1 and 138-2 in a circumferential direction and for example having a 'V'-shaped cross-section, and a shaft coupler 142 coupled to the rotary shaft 131 of the rotary body 130. The flange 138-1 adjacent to the drum 132 is formed with a through hole 140 via which the nozzle 150 passes. The recessed groove 139 is formed with a mounting groove 141 around which the foreign-substance winding portion 160 is mounted. The mounting groove 141 is provided corresponding to the bottom and lateral shapes of the foreign-substance winding portion 160. The mounting groove 141 is so deeply formed that an upper portion of the foreign-substance winding portion 160 protrudes from the recessed groove 139 by a predetermined height when the foreign-substance winding portion 160 is mounted to the mounting groove 141. The mounting groove 141 is recessed throughout the recessed groove 139 and the flange 138-2. The mounting groove 141 includes a fastening groove 144 recessed on an inner surface of the flange 138-2 toward the rotary shaft 131 so that a second standing wall 164 of the foreign-substance winding portion 160 (to be described later) can be inserted in the fastening groove 144. The fastening groove 144 prevents the inserted and fastened second standing wall 164 of the foreign-substance winding portion 160 from moving radially, and therefore the foreign-substance winding portion 160 is not taken off while rotating. Further, the foreign-substance winding portion 160 is prevented from radial movement by the through hole 140 of the flange 138-1 as well as the fastening groove 144.

The middle foreign-substance collecting groove 136 is integrally injection-molded between the drum 132-1 and the drum 132-2 of the drum assembly 132. The middle foreign-substance collecting groove 136 includes one pair of circular flanges 138-1 and 138-2 spaced apart from each other and shaped like a spool, and a recessed groove 139' provided between the pair of flanges 138-1 and 138-2 in a circumferential direction and for example having a 'V' shape. The recessed groove 139' is mounted with the middle foreign-substance winding portion 165 by insert-injection. When the rotary body 130 is provided as a single drum 132, the middle foreign-substance collecting groove 136 may be excluded. The middle foreign-substance collecting groove 136 may be manufactured separately from and then coupled to the drums 132-1 and 132-2.

Further, the recessed groove 139 is not limited to the 'V' shape, but may have various shapes such as 'W', 'U', etc.

Referring to FIG. 9, the cleaning member 145 includes cleaning brush 147 such as soft naps on a base 146, for example, a fabric woven by cotton yarn. The cleaning member 145 is provided on the circumferential surface of the drum assembly 132 and cleans the foreign substances away from the carpet or cracks in the floor. One pair of cleaning members 145 is provided on the circumferential surface by the boundary of the nozzle-mounting portion 133 in each of the drums 132-1 and 132-2. The cleaning member 145 may be divided by the number of nozzle-mounting portions 133, i.e. the number of nozzles, or may be manufactured as a cylinder to surround the whole circumferential surface of the drums 132-1 and 132-2 and then form an opening through which the nozzle 150 can pass.

One pair of nozzles 150 is inserted in and mounted to one pair of nozzle-mounting portions 133 formed on the circumferential surface of the drum 132-1 and 132-2 and spirally extended in the lengthwise direction. The nozzle 150 may for example be made of synthetic rubber, synthetic resin, natural rubber, etc. to easily guide the foreign substances on the floor to be cleaned toward the foreign-substance collecting groove 134. There are no limits to one pair of nozzles 150, and a single nozzle 150 or three or more nozzles 150 may be provided.

The nozzle 150 includes a holder 151 extended long to be inserted in the holding groove 135 of the nozzle-mounting portion 133, a connector 152 radially extended from the holder 151 and narrower than the holder 151 so as to be inserted in the holding projection 137, a bottom portion 153 transversely extended from the connector 152, and a blade portion 154 radially extended from the bottom portion 153.

The nozzle 150 is provided integrally with the foreign-substance winding portion 160 at a one end portion thereof. The nozzle 150 has the other end portion inserted up to the middle foreign-substance collecting groove 136 as the holder 151 and the connector 152 are respectively fitted to the holding groove 135 and the holding projection 137 of the nozzle-mounting portion 133. Therefore, the nozzle 150 can be firmly mounted to and supported in the drum 132-1 and 132-2. The nozzle 150 may be manufactured not spirally but straightly and then inserted in the spiral nozzle-mounting portion 133 based on transformable characteristics of an elastic material. Of course, the straight nozzle 150 is more inexpensively and easily manufactured than the spiral nozzle 150.

The holder 151 is widely extended in a direction transverse to the radial direction, and caught in and does not come out from a relatively narrow holding projection 137. Because the holder 151 is made of elastically transformable material, the holder 151 may be wider and thicker than the connector 152. The holder 151 may have a quadrangular or circular cross-section.

The connector 152 is narrowly and long extended in a radial direction to pass through the relatively narrow holding projection 137. However, the width of the connector 152 may be designed to have a proper thickness to avoid damage during the insertion.

Referring to FIG. 13, the bottom portion 153 is archwise extended along the circumferences of the drum 132-1 and 132-2. The bottom portion 153 makes the base 146 of the cleaning member 145 be partially interposed between the circumferential surfaces of the drums 132-1 and 132-2 and holds and supports the base 146. Like this, the bottom portion 153 firmly supports the base 146 of the cleaning member 145, thereby preventing the cleaning member 145 from being torn out from the drums 132-1 and 132-2.

The bottom portion 153 may include a bottom extending portion 153' extended over the outermost blades 155 and 156 of the blade portion 154 (to be described later). The bottom extending portion 153' may further secure an area for supporting the base 146 of the cleaning member 145.

Referring back to FIG. 9, the blade portion 154 includes three blades 155, 156 and 157 radially extended from the bottom portion 153 and spaced apart from one another. Like this, when three blades 155, 156 and 157 produce friction with the floor to be cleaned while rotating, the foreign substances on the floor to be cleaned are easily guided to the lateral foreign-substance collecting grooves 134 or the middle foreign-substance collecting grooves 136, thereby improving a cleaning efficiency. Spaces between three blades 155, 156 and 157 become wider from the bottom toward the top, and therefore prevent the foreign substances from being wedged between them. The blade portion 154 may alternatively include two blades or four or more blades to thereby improve a cleaning efficiency.

The central blade 157 among the three blades 155, 156 and 157 is higher than both outermost blades 155 and 156. When the drum brush 13 rotates, the central blade 157 is transformed by friction with the floor to be cleaned. In this case, the central blade 157 to be transformed is supported by one of the lower outermost blades 155 and 156 and thus prevented from being additionally transformed, thereby avoiding damage due to excessive transformation. Of course, the three blades 155, 156 and 157 may be formed to have the same height.

The three blades 155, 156 and 157 are formed to be lower than a cleaning brush 147 as shown in FIG. 9. Because the cleaning brush 147 is higher than the blade portion 154, the cleaning brush 147 contacts the floor to be cleaned. Consequently, the blade portion 154 does not directly hit the floor to be cleaned when the drum brush 13 rotates, thereby reducing hit noise.

Referring to FIG. 13, the blade portion 154 may include at least one middle coupling portion 158 extended upward from the bottom portion 153 and coupling the three blades 155, 156 and 157. The three blades 155, 156 and 157 may be easily damaged because they are extended to be thin and long and is thus likely to be deformed. Accordingly, the blade portion 154 is provided with the middle coupling portion 158 at proper intervals in between, thereby improving the durability.

Referring back to FIGS. 11 and 12, the foreign-substance winding portion 160 are provided in each mounting groove 141 of one pair of foreign-substance collecting grooves 134 positioned at both end portions of the drum assembly 132. The foreign-substance winding portion 160 is provided integrally with the one end portion of the nozzle 150. The foreign-substance winding portion 160 is capable of strongly winding the foreign substances guided and transferred by the nozzle 150, in particular, a hair, fur of an animal, and the like elongated foreign substances, with friction of a rubber material. The foreign-substance winding portion 160 may be injection-molded together with the nozzle 150 by synthetic rubber, synthetic resin, or natural rubber. Of course, the foreign-substance winding portion 160 may be manufactured separately from the nozzle 150. When the foreign-substance winding portion 160 is manufactured separately from the nozzle 150, the foreign-substance winding portion 160 may be provided in the foreign-substance collecting groove 134 by insert-injection.

The foreign-substance winding portion 160 includes first and second standing walls 161 and 164 spaced apart from each other, an inclined wall 162 inclined downward from the first standing wall 161, and a connection wall 163 connecting the inclined wall 162 and the second standing wall 164.

The first standing wall 161 is inserted in the through hole 140 of the flange 138-1. Further, the second standing wall 164 is inserted in and fastened to the fastening groove 144 of the mounting groove 141. Thus, the foreign-substance winding portion 160 is firmly supported by the fastening of the first and second standing walls 161 and 164.

The inclined wall 162 has a fanwise surface protruding higher than the surface of the foreign-substance collecting groove 134 and strongly winds the guided foreign substances, in particular, a hair or fur of animal with friction of rubber.

The middle foreign-substance winding portion 165 is provided in the recessed groove 139' of the middle foreign-substance collecting groove 136 by the insert-injection. The middle foreign-substance winding portion 165 is provided to surround the entire circumference of the recessed groove 139' unlike the foreign-substance winding portion 160. The middle foreign-substance winding portion 165 may be provided by various methods such as an adhesive (gluing) method, a hooking method, a forcible-fitting method, etc. as well as the insert-injection method.

Referring to FIG. 8, the middle foreign-substance winding portion 165 includes first and second standing walls 166 and 169 spaced apart from each other, an inclined wall 167 inclined downward from the first standing wall 166, and a connection wall 168 connecting the inclined wall 167 and the second standing wall 169.

Referring to FIGS. 6 and 10, three grinders 18 are mounted to the base member 19 and disposed adjacent to the inclined walls 162 of one pair of foreign-substance winding portions 160 and the inclined wall 167 of the middle foreign-substance winding portion 165, which are respectively provided in one pair of foreign-substance collecting grooves 134 and the middle foreign-substance collecting groove 136. Therefore, the grinder 18 grinds the foreign substances, which are guided by the nozzle 150 during the rotation of the drum brush 13 and then wound around the inclined walls 162 of the foreign-substance winding portions 160 and the inclined wall 167 of the middle foreign-substance winding portion 165, based on friction. Such ground foreign substances are collected through the suction inlet 115 and the suction channel 114 by the suction power of the cleaner main body 2.

The grinder 18 includes a plurality of inclined cutters corresponding to the inclined walls 162 of the foreign-substance winding portions 160 and the inclined wall 167 of the middle foreign-substance winding portion 165.

The grinder 18 may be made of grindstone, have a diamond-coating surface, or have a grinding file pattern through rolling process.

The foreign substances are accumulated in a gap between the grinder 18 and the inclined walls 162 and 167. When a hair and the like foreign substances accumulated in this gap exceed a certain amount, the foreign substances are cut by friction with the surface of the grinder 18. When the gap is too narrow, interference may occur by vibration of the grinder 18 and the drum assembly 132. Therefore, the gap may be greater than or equal to 1.5 mm.

The base member 19 covers the bottom of the foreign-substance suction unit 10. The base member 19 includes grinder supporters 191 shaped like an arc and respectively mounting three grinders 18 thereon, and one pair of lower drum accommodators 192 to accommodate two drums 132-1 and 132-2.

Three grinder supporters 191 are positioned at the lateral sides of one pair of lower drum accommodators 192, corresponding to the inclined walls 162 of one pair of foreign-substance winding portions 160 and the inclined wall 167 of the middle foreign-substance winding portion 165.

One pair of lower drum accommodators 192 accommodates two drums 132-1 and 132-2 while leaving a sufficient space so that the two drums 132-1 and 132-2 can rotate exposing the bottoms thereof. In this case, the exposed bottoms of the drum 132-1 and 132-2 contacts and hits the floor to be cleaned while rotating, thereby separating the foreign substances from the floor to be cleaned.

As described above, the vacuum cleaner of the disclosure employs the rubber nozzle to guide for example a hair and the like elongated foreign substances from the carpet or cracks in the floor toward the end portions of the drum.

In the vacuum cleaner according to the disclosure, the foreign-substance winding portion made of rubber or the like material having good friction is provided in the foreign-sub stance collecting grooves at both lateral sides of the drum, thereby easily and strongly winding the foreign substances guided by the nozzle. Consequently, the rotating drum brush is free from the accumulated foreign substances.

Further, the nozzle and the foreign-substance winding portion used in the vacuum cleaner according to the disclosure are easily manufactured.

Further, the nozzle and the foreign-substance winding portion in the vacuum cleaner according to the disclosure are firmly mounted to the drum and the foreign-substance collecting groove.

Although a few embodiments of the disclosure have been shown and described, the disclosure is not limited to the foregoing specific embodiment, and it will be appreciated by those skilled in the art to which the disclosure pertains that various changes can be made in these embodiments without departing from the principles and spirit of the present disclosure, the scope of which is defined in the appended claims and their equivalents, and such alternative embodiments are not understood independently of the technical concept or prospect of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A vacuum cleaner comprising:

a foreign-substance suction unit comprising:

a cleaner main body configured to generate suction power, and a drum brush configured to suck foreign substances by the suction power rotating on a floor to be cleaned, the drum brush comprising:

a rotary body comprising a cylindrical drum and foreign-substance collecting grooves formed at opposite end portions of the cylindrical drum along a circumferential direction;

a cleaning member disposed on a circumferential surface of the cylindrical drum;

a nozzle spirally extended across the cleaning member along a lengthwise direction of the cylindrical drum and configured to guide foreign substances toward the foreign-substance collecting grooves; and a foreign-substance winding portion disposed in a portion of the foreign-substance collecting grooves and configured to wind the guided foreign substances.

2. The vacuum cleaner of claim 1, wherein the foreign-substance winding portion is formed at one end portion of the nozzle as a single body.

3. The vacuum cleaner of claim 1, wherein the foreign-substance suction unit comprises a grinder provided at a predetermined distance from the foreign-substance winding portion and configured to cut foreign substances wound around the foreign-substance winding portion.

4. The vacuum cleaner of claim 1, wherein the nozzle and the foreign-substance winding portion comprise synthetic rubber, synthetic resin, or natural rubber.

5. The vacuum cleaner of claim 1, wherein the nozzle comprises two or more blades arranged side by side along a lengthwise direction leaving a space therebetween.

6. The vacuum cleaner of claim 5, wherein:

the cylindrical drum comprises a nozzle-mounting portion comprising:

a holding groove spirally and penetratingly extended along a lengthwise direction, and a holding projection opened with a width narrower than the holding groove in the circumferential direction of the cylindrical drum and communicating with an outside, and the nozzle comprises:

a holder extended to be inserted in the holding groove, and a connector narrower than the holder, inserted in the holding projection, and configured to connect the two or more blades and the holder as a single body.

7. The vacuum cleaner of claim 5, wherein one of the two or more blades is higher than the other blades.

8. The vacuum cleaner of claim 5, wherein:

the nozzle comprises three blades arranged side by side along a lengthwise direction leaving a space therebetween, and a central blade among the three blades is higher than the other blades.

9. The vacuum cleaner of claim 5, wherein the nozzle comprises:

a bottom portion connecting bottoms of the two or more blades; and a bottom extending portion extended from the bottom portion over an outermost blade.

10. The vacuum cleaner of claim 5, wherein the nozzle comprises:

a bottom portion connecting bottoms of two or more blades; and at least one middle coupling portion extended upward from the bottom portion and configured to couple the two or more blades.

11. The vacuum cleaner of claim 9, wherein the bottom portion is extended and includes an arch shape along the circumferential direction of the cylindrical drum.

12. The vacuum cleaner of claim 5, wherein:

the cleaning member comprises a base and a cleaning brush provided on the base; and each of the two or more blades includes an upper end lower than the cleaning brush.

13. The vacuum cleaner of claim 1, wherein each of the foreign-substance collecting grooves comprise:

a pair of flanges spaced apart from each other; and a recessed groove formed between the pair of flanges along the circumferential direction.

14. The vacuum cleaner of claim 13, wherein each of the foreign-substance collecting grooves comprise a mounting groove to which the foreign-substance winding portion is mounted.

15. The vacuum cleaner of claim 14, wherein the foreign-substance winding portion is mounted to the mounting groove and protrudes from a surface of the recessed groove of the foreign-substance collecting grooves.

16. The vacuum cleaner of claim 1, wherein the foreign-substance winding portion comprises:

a first standing wall and a second standing wall standing spaced apart from each other;

an inclined wall inclined downward from the first standing wall; and a connection wall connecting the inclined wall and the second standing wall.

17. The vacuum cleaner of claim 16, wherein each of the foreign-substance collecting grooves comprises a mounting groove comprising:

a through hole passing through a flange that is adjacent to the cylindrical drum and between a pair of flanges, and a fastening groove recessed in the other flange of the pair of flanges in a central axis direction of the cylindrical drum, wherein the first and second standing walls are respectively inserted in the through hole and the fastening groove.

18. The vacuum cleaner of claim 1, wherein the rotary body comprises at least one middle foreign-substance collecting groove between opposite end portions thereof, and the cylindrical drum comprises at least two drums separated by the at least one middle foreign-substance collecting groove.

19. The vacuum cleaner of claim 18, wherein the drum brush comprises a middle foreign-substance winding portion mounted to the at least one middle foreign-substance collecting groove by insert-injection.

20. The vacuum cleaner of claim 1, wherein the nozzle comprises three blades arranged side by side along a lengthwise direction leaving a space therebetween, wherein a central blade among the three blades is higher than the other blades.

* * * * *